United States Patent [19]

Denis

[11] Patent Number: 5,069,139

[45] Date of Patent: Dec. 3, 1991

[54] PROJECTILE INTENDED TO BE FIRED BY A FIRE-ARM

[76] Inventor: Jean-Pierre Denis, 5, via Clément Ader, F-78140 Velizy, France

[21] Appl. No.: 362,439

[22] PCT Filed: Oct. 4, 1988

[86] PCT No.: PCT/FR88/00491

§ 371 Date: Jun. 2, 1989

§ 102(e) Date: Jun. 2, 1989

[87] PCT Pub. No.: WO89/03015

PCT Pub. Date: Apr. 6, 1989

[30] Foreign Application Priority Data

Oct. 5, 1987 [EP] European Pat. Off. ..... 87 402203.1
Oct. 23, 1987 [EP] European Pat. Off. ..... 87 402392.2

[51] Int. Cl.[5] ..... F42B 12/06; F42B 14/04

[52] U.S. Cl. ..... 102/518; 102/511; 102/516

[58] Field of Search ..... 102/501, 511, 514–519

[56] References Cited

U.S. PATENT DOCUMENTS

| | | | |
|---|---|---|---|
| 681,448 | 8/1901 | Gathmann | 102/526 |
| 2,322,751 | 6/1943 | Studler | 102/516 |
| 2,336,143 | 12/1943 | Werme | 102/514 |
| 2,792,618 | 5/1957 | Walker | 102/517 |
| 3,302,570 | 2/1967 | Marquardt | 102/518 |
| 3,795,196 | 3/1974 | Hillenbrand | 102/518 |
| 4,708,063 | 11/1987 | Ladriere | 102/516 |

FOREIGN PATENT DOCUMENTS

| | | | |
|---|---|---|---|
| 819445 | 8/1969 | Canada | 102/517 |
| 308593 | 12/1919 | Fed. Rep. of Germany | 102/516 |
| 211778 | 7/1909 | Fed. Rep. of Germany | 102/501 |
| 1236976 | 1/1960 | France | 102/514 |
| 1240110 | 7/1960 | France . | |
| 764833 | 5/1974 | France | 102/517 |
| 2540239 | 8/1984 | France . | |
| 19353 | of 1913 | United Kingdom | 102/501 |
| 887124 | 1/1962 | United Kingdom | 102/517 |

*Primary Examiner*—Harold J. Tudor
*Attorney, Agent, or Firm*—Pollock, Vande Sande and Priddy

[57] ABSTRACT

A projectile adapted to be fired by a firearm comprises anchoring means between the outer surface of the tail (3) and the corresponding inner surface of the jacket (7), and the head (2) of the core (1) is connected to the tail by a shoulder (6) and, opposite the tail, the jacket (7) has a rear portion (12) which is of greater thickness than the remainder of the jacket, this rear portion (12) having on the outside undulations (13) adapted to form circular grooves substantially at right-angles to the longitudinal axis of the projectile, a free space (14) being provided between the shoulder (6) and the corresponding part of the jacket (7).

18 Claims, 6 Drawing Sheets

PROJECTILE INTENDED TO BE FIRED BY A FIRE-ARM

The invention relates to a projectile intended to be fired by a fire-arm.

The invention refers particularly to a projectile consisting of a hard core surrounded by a continuous jacket of ductile material adapted to cooperate with the rifling in the fire-arm.

The prior art embraced various projectiles of this type.

French Patent No. 2 540 239 describes a projectile in which a space is provided between the jacket and the core in order to reduce friction between the projectile and the barrel. Such an arrangement is interesting but does have a number of drawbacks.

The projectile which penetrates a soft body is required to retain its initial shape ; on the other hand, if it encounters a hard body, for example an armoured plate, it ought to jettison its jacket in order to pass through the said body. With this type of projectile, the connection between the jacket and the core has been found to be rather poor, with a consequent tendency for the jacket to be stripped off even when the projectile is penetrating a body which is not very hard. Furthermore, when the projectile is set in motion, there is a certain risk of slip to occur between the core and the jacket which adversely affects the range and accuracy of the projectile.

A similar arrangement is described in French Patent No. 1 240 110 and consequently this suffers from the same faults.

It has likewise been envisaged to produce a projectile in which the core is extended by a frustoconical tail engaged with force into a ductile sleeve. One of the disadvantages of this technique is that upon impact against a hard surface, the jacket spreads out and so forms a collar which arrests penetration of the projectile.

It is in particular an object of the present invention to provide a projectile which remedies these various drawbacks in order to produce ammunition which is referred to as "ordinary, tracer, piercing, incendiary piercing, tracer incendiary piercing, incendiary, explosive and reduced shot ammunition".

It is likewise an object of the present invention to create a projectile in which in particular a striker body is rigid with the core, at least throughout the trajectory of the projectile, so ensuring excellent sealing-tightness between the projectile and the barrel, as well as on the inside of the core of the projectile and between it and the jacket, which makes it possible if necessary to increase the piercing effect of the projectile.

To this end, the invention relates to a projectile of the above type which is characterised by anchoring means between the outer surface of the tail and the corresponding inner surface of the jacket.

According to another characteristic feature of the invention, the head of the core is connected to the tail by a shoulder and, opposite the tail, the jacket comprises a rear portion which is of greater thickness than the remainder of the casing, this rear portion having on the outside undulations which form circular grooves substantially at right-angles to the longitudinal axis of the projectile and a free space being disposed between the shoulder and the corresponding part of the jacket.

The invention provides a projectile which offers numerous advantages:

a) the jacket and the core form one unitary body so that they are propelled at one and the same speed of rotation, the accuracy and performance also being enhanced;

b) upon impact against a soft surface, the jacket remains intact;

c) upon impact, on a hard surface, the core can be stripped bare after a slight delay so avoiding the formation of a bead around the core;

d) friction inside the barrel is reduced to the minimum necessary;

e) the hammer-hardened material of the casing which is worked while the projectile is passing through the barrel finds its place, so avoiding the risks of the said jacket tearing;

f) by reason of the thickness of the rear portion of the jacket, the risks of this becoming separated from the core are avoided, so further increasing accuracy.

In particular, according to an advantageous characteristic feature, the projectile comprises an axial housing provided in the core and open towards the rear of the core, a locking member, the striker body of which the cross-section corresponds to that of the housing and with, at the front, a shape matching that of the locking member in order to receive it and cooperate with it by reason of the matching shapes being joined by the effect of a thrust exerted on the rear of the striker body, the respective dimensions of the locking member and those of the inside of the housing being such that the striker member can only be introduced into the housing under force and/or under the effect of the shot being discharged, in order to establish a connection between the striker body and the core.

In a projectile according to the invention, the striker body is either completely embedded in the housing in the core when the projectile is manufactured or the striker body projects slightly (by a few millimetres) from the core, although when the shot is fired, the rise in pressure in the casing produces not only ejection of the projectile but also exerts a thrust on the striker body which is thus rendered thoroughly rigid wit the locking member inside the core so that the core and the striker body become completely integrated, avoiding any even slight detachment which might prejudice the movement of the projectile along its trajectory or the outcome of the projectile striking its target.

When the striker body is completely embedded in the core, its kinetic energy at the moment of impact completes the kinetic energy of the core proper and enhances the result.

When, in spite of the fact that the shot has been fired, the striker body is not completely embedded in the core although it may be sufficiently rigid with it to avoid any relative movement of the one in respect of the other while the projectile is travelling along its trajectory, including its travel inside the barrel, at the moment of impact against a solid object, the striker body, as its name indicates, creates a striking effect which enhances the efficiency of the core.

The complementary embedding of the striker body into the core furthermore ensures sealing-tightness at the rear of the projectile, avoiding any separation of the core from the jacket, which separation in the case of prior art projectiles is highly prejudicial to the internal and external ballistics and to the result at the moment of impact. Furthermore, the radial stresses engendered by locking of the striker body on the locking member will very slightly increase the diameter of the projectile and ensure greater sealing-tightness thereof inside the barrel and may even compensate for wear and tear of the barrel.

According to another charasteristic feature of the invention, the locking member inside the housing of the core is finger-shaped and the corresponding shape of the striker body is a housing adapted to receive the locking member.

This embodiment of the locking member inside the housing and of the matching shape of the striker body permits of excellent connection of these two parts in terms of projectile motion over its trajectory, while at the same time if necessary permitting of the "end-of-travel" movement of the striker body in respect of the core at the moment of impact.

To this end, it is particularly interesting that the inside surface of the housing of the core and the outer surface of the inertia block comprise helical groove/rib assemblies so that if there is a relative movement between the core and the inertia block, this movement is translated into a rotational pulse which is imparted to the core.

However, only one of these two elements may have a helical groove or rib while the other element is forced onto it. This considerably simplifies manufacture.

Furthermore, in each case, the grooves may be total or partial.

These helical ribs and/or grooves may be provided so that when the shot is fired the striker body, being displaced in relation to the core, communicates to this latter an initial rotational movement component which, correctly orientated by the correct orientation of the grooves and/or ribs, thus creates a powerful rotation pulse so that the projectile arrives at the start of the grooves already with a rotational movement substantially identical to that which it will have while passing along the grooves.

Thus, in all cases, the means of the invention assist the rotational launching of the projectile from the inside, that is to say by reason of the element (core and striker body) having the greatest inertia which in addition relieves the strain on the connecting links between the guided jacket and the core.

According to a second possible embodiment, this relative rotational movement is used at the point of impact, the striker body then suffering displacement in relation to the core which strikes the target. Thanks to the shape of the grooves/ribs, this relative movement is translated into a powerful rotational pulse imparted to the core, increasing its piercing characteristics. It should be noted that this striker body effect is found only when the projectile encounters a hard obstacle.

According to another characteristid feature, the inner surface of the tail or skirt of the striker body is of frustoconical shape so that the skirt opens out when the striker body is forced onto the finger-shaped member.

This shape of the part of the striker body which is intended to be rotationally locked together with the locking member of the core is of particularly simple and interesting construction while guaranteeing rotational rigidity.

According to another characteristic feature of the invention, the outer surface of the core comprises helical grooves cooperating with the jacket. The grooving is continuous over all or part of the outer surface of the core. In the case of a core which carries humps (or channels), the helical grooving is provided on the crest of the humps.

Furthermore, in the case of a core on which there are shoulders, there is provision for the shoulder to be helically grooved or corrugated.

Thanks to this grooving of the outer surface of the core and the corrugations on the shoulder, if such exists, and in accordance with the helical shape of the grooving, so the jacket or, if applicable, the sleeve, will slide on this latter only upon impact against a hard obstacle and will impart to the core an additional rotational pulse corresponding to its kinetic energy. Furthermore, as the case may be, the sleeve or the jacket may be jettisoned in the form of strips by the grooves and corrugations, avoiding the piercing phase being upset by the core as happens with certain prior art projectiles.

Such an arrangement will be all the more interesting for projectiles having rear pilots or guides. Indeed, over and above those advantages already mentioned, it will be possible at the moment of installing the two elements to have the lips of the guide penetrate into the corrugations on the shoulder of the core either by simple assembly or by deformation. The purpose of this will be to ensure locking on the sleeve and will avoid the lips on the latter rising up again by however little on the shoulder when the shot is fired. Such an arrangement will avoid the prior art faults of inadequate accuracy and the fact of the guide being stripped off when the projectile passes through soft obstacles.

According to another characteristic feature of the invention, the striker body comprises a heel to ensure sealing-tightness of the housing which accomodates the striker body.

According to another characteristic, the heel comprises a turbine.

It is particularly interesting that the heel comprises elements which form a turbine in such a way as to complete entrainment of the projectile by the gases which are moving in a helical fashion inside the barrel.

Finally, according to another characteristic feature of the invention, into the gaps or chambers which remain between the striker body and the core, active charges are introduced ; locking of the striker body in relation to the core is sufficient to avoid any relevant movement between the striker body and the core when the shot is discharged, but at the moment of impact against a hard object, the striker body compresses the active charge or charges by being displaced in respect of the core, causing such charges to be activated.

According to another characteristic feature of the invention, the heel or the rear part of the striker body comprises sealing means which engage or cooperate with the corresponding surface of the core to complete the sealing-tightness of this latter and retard the sliding movement of the jacket upon impact against a hard object.

The invention will be described in greater detail with reference to particular forms of embodiment given by way of example only and shown in the appended drawings, in which.

Figure 1:
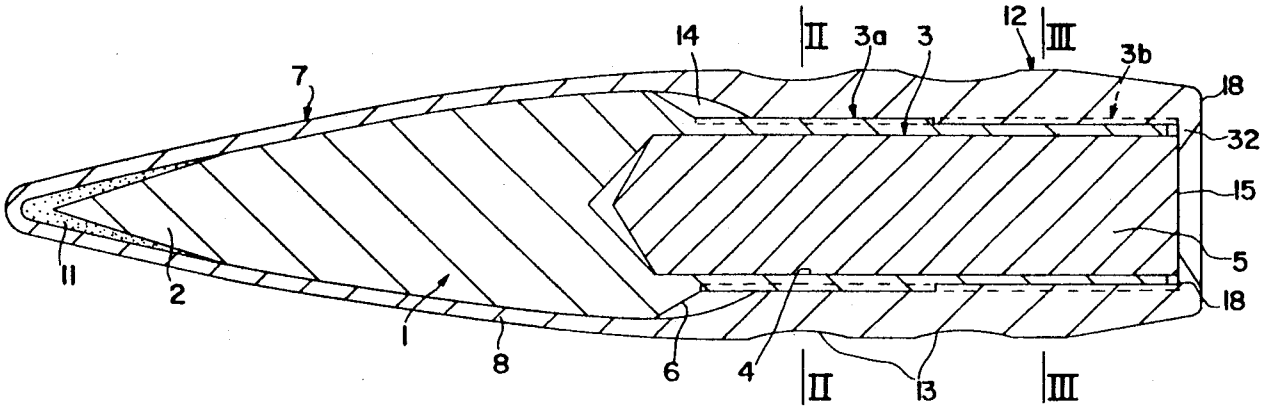
FIG. 1 is a longitudinal section through a projectile according to the invention.

The projectile shown in FIG. 1 comprises a core 1 of a hard material, for example steel. The core 1 comprises a head 2 of ogival shape and a substantially cylindrical tail 3.

Figure 2:
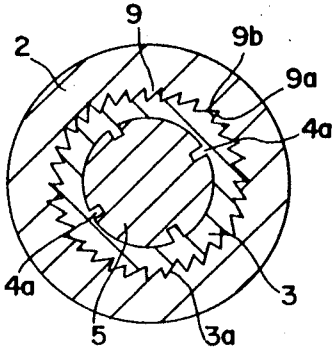
FIG. 2 is a sectional view taken on the line II—II in FIG. 1.

The tail 3 comprises an axial housing 4 adapted to receive an inertia block 5, rigid with the core and making it possible to ensure positioning of the centre of gravity and, at impact, the creation of a ram effect in order to improve penetration. The housing 4 comprises flats 4*a* for rigid fitment of the inertia block 5 (see FIG. 2).

The tail 3 and the head 2 are connected by a frustoconical shoulder 6 of which the small base is turned towards the side of the tail 3.

The core 1 is housed in a jacket 7 of ductile material which comprises a portion 8 matching the head 2 of the core while a free space 11 is disposed between the tip of the latter and the corresponding end of the jacket in order to make it possible to insert a lubricating element such as metal, plastics material, or powder in order to improve piercing performance when there is no angle of entry.

The tail 3 (see FIGS. 2 and 3) comprises two portions 3*a* and 3*b*, the portion 3*a* adjacent to the shoulder 6 being provided with ridges 9 each of which has a radial edge 9*a* and an inclined edge 9*b* joining the base of the adjacent edge 9*a*. The radial edges 9*a* are turned towards the same side as the thrust which generates rotation of the projectile.

Portion 3*b* of the tail 3 comprises regularly angularly offset grooves 10.

The portion 8 of the jacket is extended by a rear portion 12 which engages into the ridges 9 and into the grooves 10 by its inner surface. This rear portion 12 is of far greater thickness than the portion 8 and has on its lateral surface undulations which form circular grooves 13 which are substantially perpendicular to the longitudinal axis of the projectile.

The rear portion 12 is so disposed that it leaves a free space 14 in the vicinity of the shoulder 6. Thus, by virtue of the undulations 13, only the projecting parts cooperate with the grooves in the fire-arm barrel, which on the one hand reduces friction while on the other it also reduces wear and tear on the grooves.

As engagement of the rear portion 12 of the jacket 7 into the grooves gives rise to a hammer-hardening of the jacket, the free space 14 makes it possible to absorb deformation of the jacket 7 which makes it possible likewise to reduce wear and tear on the grooves and avoid tearing of the jacket 7.

Figure 9:
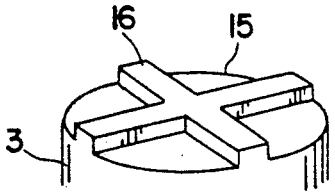
FIGS. 9, 10, 11, 12 and 13 are perspective view of the rear end of the tail of the core of the projectile showing different embodiments.

The free end of the rear portion of the jacket 7 is shrunk against the free end 15 of the tail 3. This free end 15 may comprise relief portions in order to ensure perfect anchoring between the jacket and the core. FIG. 9 shows such relief portions which are formed by a ribbed cross 16.

Figure 10:
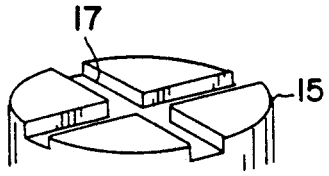

FIG. 10 shows an alternative form of free end 15 of the tail 3 with a recessed cross 17.

Figure 11:
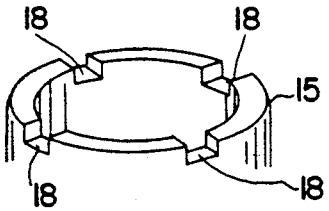

FIG. 11 shows an alternative form of free end 15 of the tail 3 having four flats 18 which are regularly offset angularly.

Figure 12:
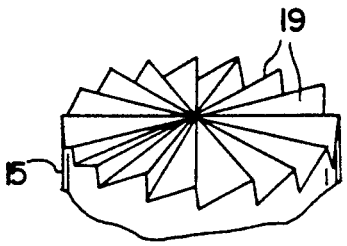
Figure 15:
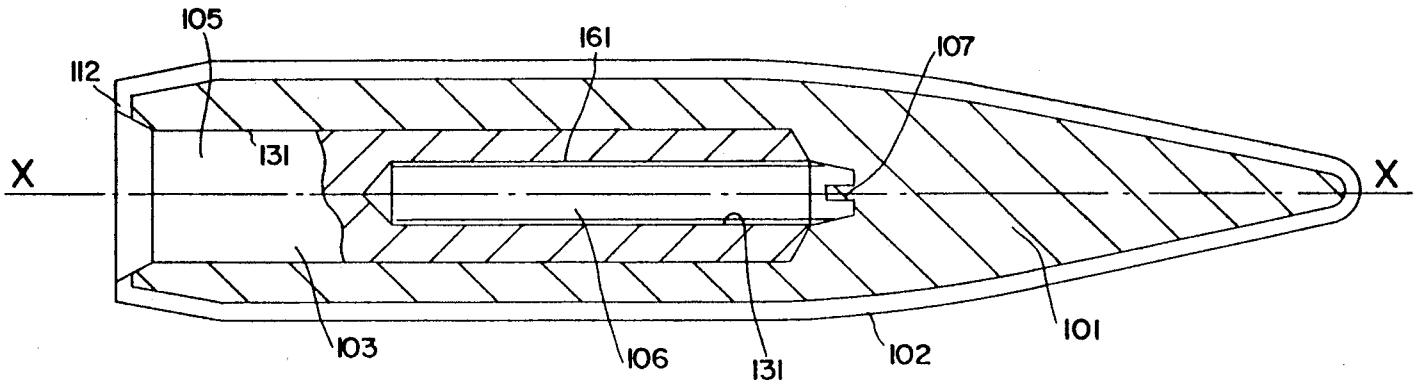
FIG. 15 is a sectional view of an example of projectile according to the invention which is fitted with its striker body.

FIG. 12 shows a series of radial ridges 19 provided at the free end 15 of the tail 3. These ridges are inclined in the same direction as the ridges 9.

Figure 13:
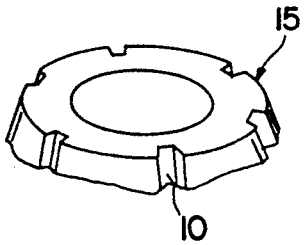

Finally, according to FIG. 13, the free end of the tail is slightly frustoconical, the grooves 10 opening out on this end.

Figure 4:
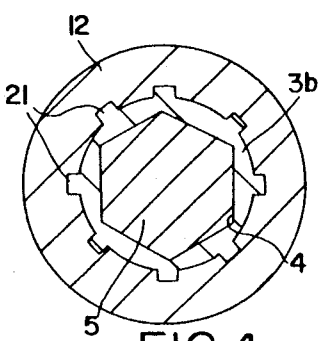
FIG. 4 is a sectional view similar to that in FIG. 3 but showing an alternative embodiment.

As FIG. 4 shows, in the portion 3*b* instead of the grooves 10 there are projections 21 and the housing 4 is in the form of six flat surfaces, the inertia block 5 being correspondingly shaped.

Figure 5:
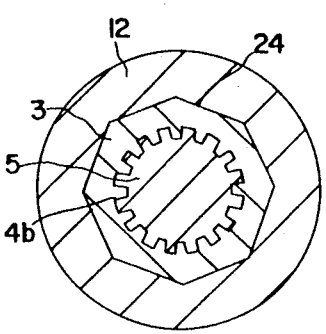
FIG. 5 is another sectional view showing an alternative embodiment.
Figure 3:
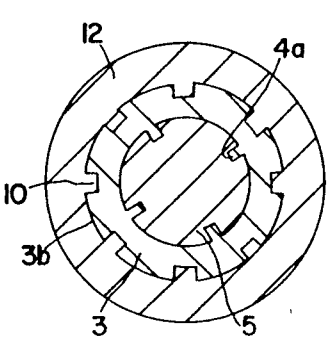
FIG. 3 is yet another sectional view taken on the line III—III in FIG. 1.

In the embodiment shown in FIG. 3, the tail 3 comprises two series of means of anchoring the jacket 7 ; it will be possible to provide a single series of anchoring means and the tail 3 could be polygonal in shape. In FIG. 5, the tail 3 is of octagonal cross sectional and has flat surfaces 24 to ensure intimate connection with the portion 12 of the jacket. In this alternative embodiment, the housing 4 comprises axial grooves 4*b*.

Figure 8:
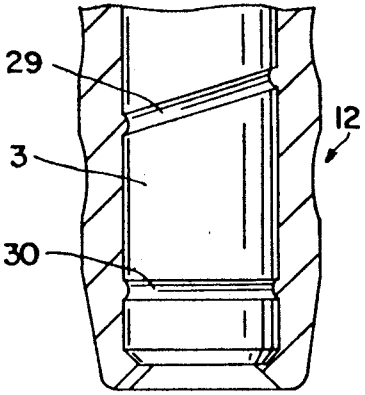
FIGS. 6, 7 and 8 are cross-sectional views of the tail of the projectile in three other forms of embodiment.
Figure 7:
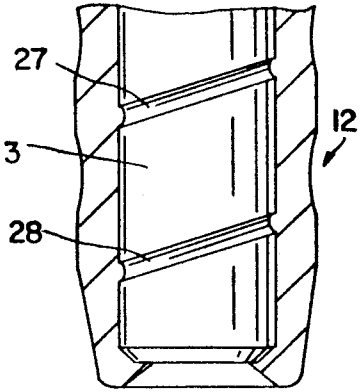
Figure 6:
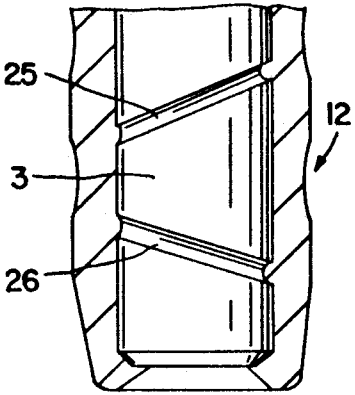

FIGS. 6, 7 and 8 show further alternative embodiments of anchoring of the jacket portion 12 on the tail 3.

In the embodiment shown in FIG. 6, the tail 3 comprises a first groove 25 inclined in relation to the longitudinal axis of the tail 3 and a second groove 26 which is inclined in the opposite direction.

In the alternative embodiment shown in FIG. 7, the tail 3 has two grooves 27 and 28 situated in parellel planes which are inclined in respect of the longitudinal axis of the tail.

Finally, the tail 3 in FIG. 8 shows an inclined groove 29 and a groove 30 situated in a plane at right-angles to the longitudinal axis of the core 1.

In order to achieve a perfect fitment together of the jacket and the core, it is also possible to make a glued or welded connection between the tail 3 and the rear portion 12.

When the powder ignites, to avoid the gases which propel the projectile finding their way between the jacket and the core, the shrinking-on fitment of the jacket forms a tight seal, by a thinning of the free edge 32 of the shrunk-on portion.

Likewise (see FIG. 14), it is possible to achieve sealing-tightness at the rear end of the projectile by another means.

Figure 14:
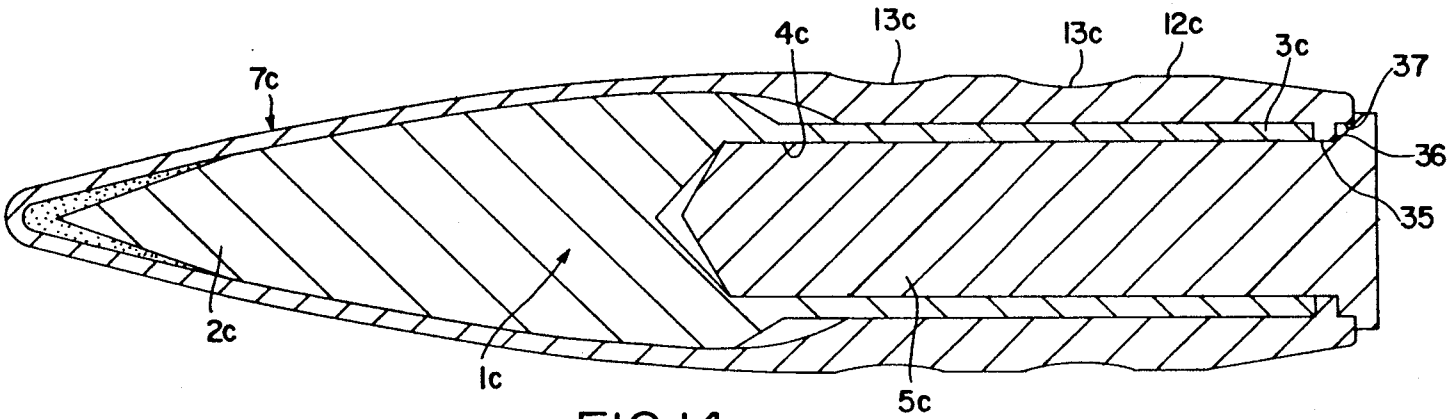
FIG. 14 is a longitudinal sectional view showing a projectile according to an alternative embodiment.

For the description of this FIG. 14, the same references have been used as in the previous figures to designate identical portions, but the letter "c" has been added.

The projectile comprises a tail 3c in which there is an axial cavity 4c to accomodate an inertia block 5c. The part 35 of the rear end 12c of the jacket 7c is shrunk onto the corresponding free end of the tail 3c, providing a shoulder 36 and a skirt 37 while the inertia block 5c extends beyong the skirt 37, the shoulder 36 being included within it.

Figure 16:
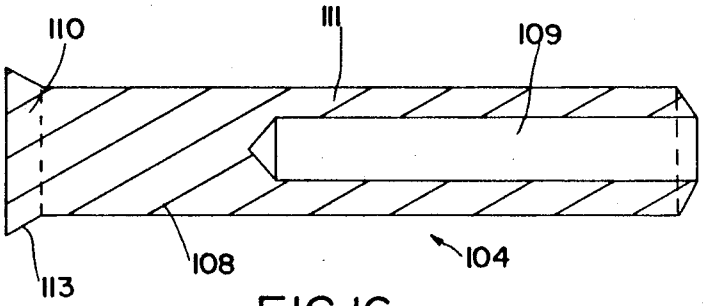
FIG. 16 is sectional view of an embodiment of striker body for the projectile shown in FIG. 15.

According to FIGS. 15, 16, 17, 18, the projectile of the invention which is intended to be fired by a fire-arm is composed of a core 101 which forms an active mass ; it is enclosed in a jacket 102 and comprises a housing 103 to receive a striker body 104 (FIG. 16).

Aligned on the axis X—X of the projectile, the housing 103 is open at the rear 105 of the projectile. On the inside, this housing comprises a locking member 106 which is in the form of a finger rigid with the core 101. This finger-shaped member 106 may either be of the same material as the core 101 and may be made at the same time as the core 101, or it may be produced separately and be fixed to the core by a connecting means 107 which is rotationally rigid so that the member 106 is not able to turn in respect of the core 101.

However, as will be seen later on, the stresses exerted between core and striker body are sufficient in the majority of cases to ensure rotational rigidity.

Between the locking member 106 and more particularly between the cylindrical surface 161 thereof and the inner surface 131 of the housing 103, there is an annular space.

The housing 103 and in particular its inner surface 131 as well as the locking member 106 and its surface 161 are preferably bodies of symmetry of rotation in respect of the axis X—X or bodies of revolution about the axis X—X.

The striker body 104 which is adapted to be placed in the housing 103 consists of a body 108 of cylindrical shape provided in its front part with a housing 109 of which the shape, the cross-section and the length are adapted to the shape, the cross-section and the length of the locking member 106. At the rear, the mass 108 is solid and ends in a heel 110 which is, for instance, frustoconical, and of which the conicity corresponds substantially to that of the rear opening 105 of the housing 103 of the core 101.

Figure 18:
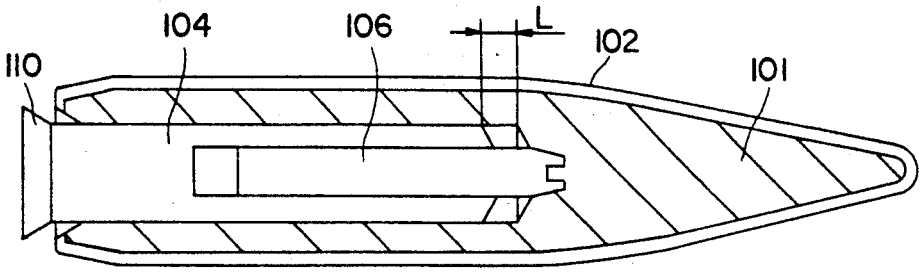
FIG. 18 is a sectional view of the projectile complete with its striker body according to FIGS. 15 and 16 or 17.

The striker body 104 is adapted to be placed in the core 101 as shown in FIG. 18. In fact, FIG. 18 shows the relative position of the striker body 104 and of the active core 101, for example at manufacture, when the projectile is mounted in the cartridge, not shown.

According to circumstances, upon completion of assembly of the projectile, the striker body 104 is completely enclosed in the core 101 or only partially as shown in FIG. 18.

In any case, the skirt 111 fits on the member 106 in order effectively to render the striker body 104 rigid with the core 101 to prevent any relative rotation of the one in respect of the other over the trajectory of the projectile.

In certain cases, the striker body 104 is completely embedded in the core 101 thus, the function of the mass 104 is to increase the energy generated by the projectile at the moment of impact.

In the event of the striker body 104 not being fully enclosed in the housing 103 so that a length L remains for additional insertion, the rigid connection of the striker body 104 and core 101 is such that it prevents any relative rotation between these two parts when the projectile is traveling along its trajectory both inside and outside the barrel ; it is only at the moment of impact against a hard surface that the striker body 104 travels over the distance L and releases its energy.

The path travelled by the striker body 104 may be utilised in order to impart to the core 101 an additional rotational pulse at the moment of impact in order to increase the piercing effect of the projectile. This rotational pulse is communicated to the core 101 by a suitable linking means described hereinafter.

The respective shape of the housing 103, of the skirt 111 and of the member 106 are such that the striker body 104 and the core 101 are locked rigidly together. For this, the surface 131 may, for instance, be slightly frustoconical ; it may also be the same as the outer surface of the skirt 111 or may take the shape of the inner surface of the skirt and that of the member 106.

According to a simple embodiment, the skirt 111 consists of branches which move aside under the effect of insertion of the member 106. In the simplest case, the member 106 is a cylindrical or frustoconical rod.

It may likewise be interesting to insert the striker body 104 only partially at the manufacturing stage and to utilise a first translatory movement from the discharge of the shot and, thanks to helical rifling on the inside of the projectile, between the striker body 104 and the core 101, launching of the projectile can be assisted, the rotary motion being initiated in the barrel and at the entrance to the rifling. For this movement, the striker body 104 and the core 101 are at the same time rendered rigid without thereby losing the free length L which will be short.

The rear frustoconical portion 110 which bears on the wall of the rear opening 105 completes the locking and ensures perfect sealing-tightness while retaining captive or if need be locking the edge 112 of the jacket 102.

Particularly, this frustoconical part 110 may have engaging means 113 which engage into the jacket 102 and into the surface of the rear aperture 105 of the core 101 to enhance rigid connection and engagement.

This makes it possible likewise to achieve gas-sealing-tightness in such a way as to avoid any even slight lack of cohesion or segregation of the three parts of the projectile the core 101, the striker body 104 and the jacket 102 and which would prejudice the internal and external ballistics and also the performance figures.

It should be noted that according to the material used for the striker body 104, so the head of the core enhibits greater elasticity due to the more or less considerable depth of the housing of the core.

Finally, even in a smooth bore barrel, the invention makes it possible to impart a rotational effect to the projectile.

Figure 17:
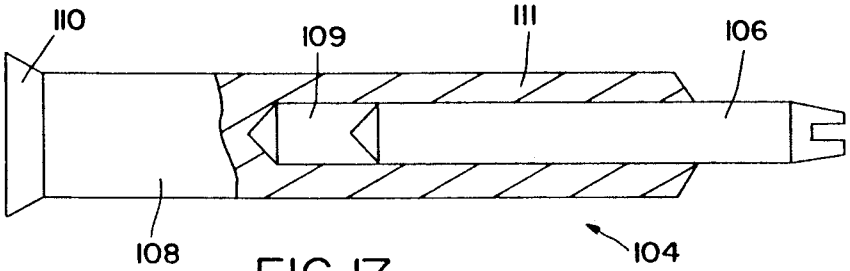
FIG. 17 is an alternative embodiment of the striker body already provided with the prefitted locking member.

FIG. 17 illustrates an interesting alternative embodiment of striker body. In this case, the striker body 104, the core 101 and the locking member 106 are produced separately, after which firstly the striker body 104 is assembled to the member 106, the latter being introduced into the striker body without, however, moving aside the skirt 111 in order not to prevent subsequently positioning of this preassembled assembly in the housing of the active core.

This procedure makes it possible on the one hand to provide a preassembled assembly (striker body 104 and finger-shaped member 106) and also to produce a projectile which is already assembled but which is without its striker body.

This method of separately producing the two assemblies is possible because the main purpose of the locking member 106 is to provide a spacing wedge.

Figure 19:
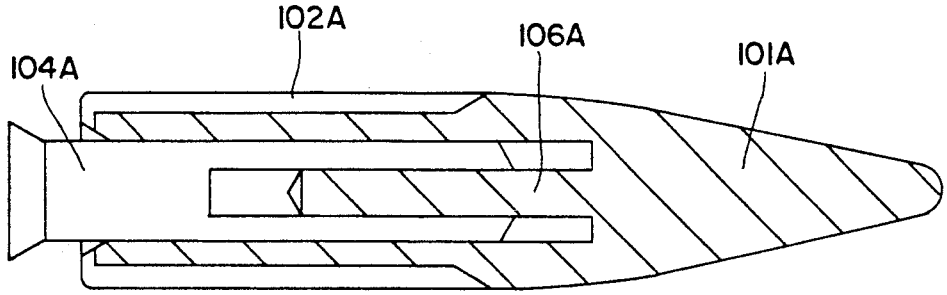
FIG. 19 is a sectional view of an alternative embodiment of the projectile according to the invention.

FIG. 19 shows another embodiment of a projectile according to the invention. This projectile which has a striker body 104A is distinguished from the projectile in FIGS. 15, 16, 17, 18 in that the jacket 102A covers only the rear part of the core 101A and not the whole of this core. For the rest, the characteristic features are substantially identical. However, it should be noted that in this second embodiment, the locking member 106A is produced in one single piece with the core 101A. According to an alternative embodiment, not shown, this member 106A could likewise be produced separately and then made rigid with the core 101A by a connecting means, not shown.

Figure 20:
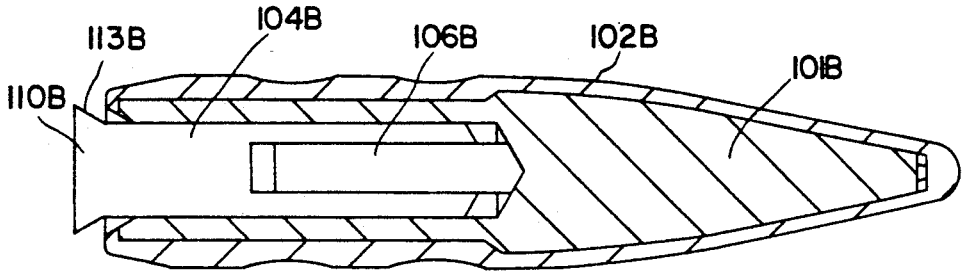
FIG. 20 is a sectional view of another example of the projectile according to the invention.

FIG. 20 shows an alternative embodiment of the invention in which the jacket 102B covers the whole of the core 101B.

The engaging member 106B and the striker body 104B essentially correspond to the embodiment described hereinabove. The sealing-tight members 113B on the heel 110B of the striker body 104B should be noted.

Figure 21:
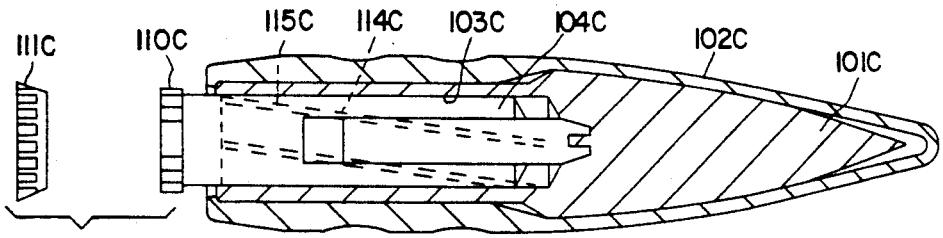
FIG. 21 is a sectional view of a projectile of which the striker body is equipped with a turbine according to another embodiment of the invention.

FIG. 21 shows an alternative embodiment of the projectile 101C in FIG. 20. This embodiment is different from the previous one in that the striker body 104C comprises grooves or ribs 114C cooperating with matching members (grooves or ribs) 115C provided in the wall of the housing 103C. In this case, if at the moment of manufacture and after discharge of the shot, the striker body 104C is not completely embedded into its housing although it is sufficiently embedded therein to be rigid with the core 101C, at the moment of impact against the hard surface, the distance L which the striker body is still able to travel in relation to the core 101C makes it possible to impart a fresh rotational impulse to the core 101C to improve its ability to pierce the objective.

In the rear portion, the striker body 104C comprises an end portion 110C (or according to an alternative embodiment, a portion 111C) which is turbine-shaped in such a way as to utilise the energy of the gases which move in a helical pattern inside the barrel of the weapon after the shot has been fired. This makes it possible to impart a complementary rotational impulse to the projectile which is rotationally rigid with the striker body and to maintain satisfactory rotation.

Figure 22A:
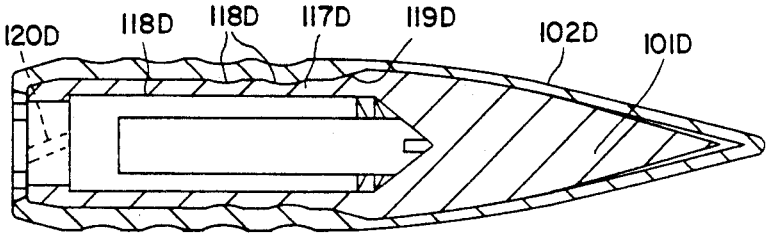
FIG. 22A shows another alternative embodiment of the invention.

The embodiment of projectile shown in FIG. 22A is of a type approximating that in FIGS. 20 and 21 except that the outer surface of the rear portion 117D of the core 101D comprises humps 118D together with helical grooves and/or ridges. The shape of the corresponding part of the jacket 102D may likewise have humps.

Finally, at the level of the zone 119D which forms the shoulder on the core 101D and at the rear 120D, it is likewise possible to have helical grooves or ridges.

Figure 22B:
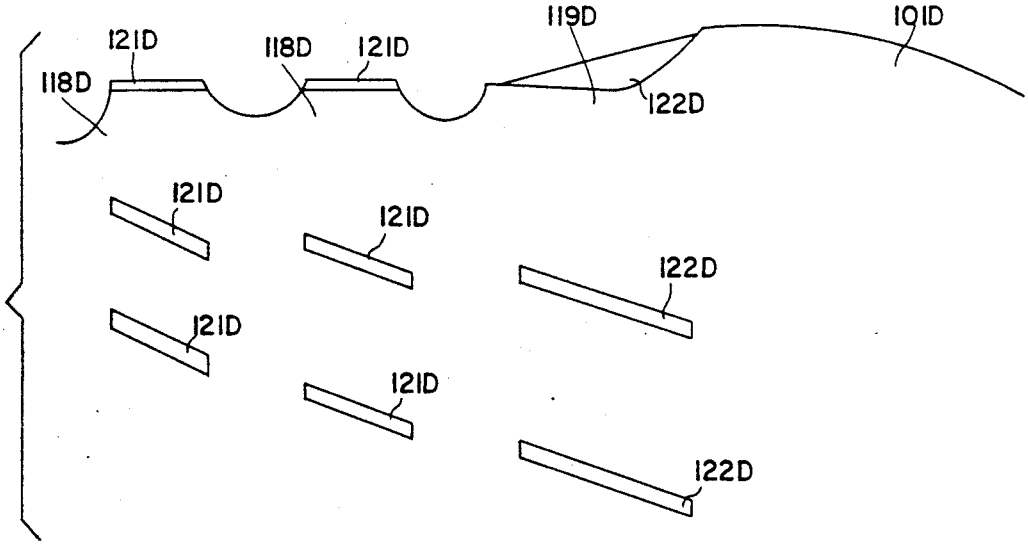
FIG. 22B is a detail shown on an enlarged scale to illustrate a part of the core and showing the grooving-/ridging.

FIG. 22B shows diagrammatically and on an enlarged scale the shape of the grooving 121D and of the ridges 122D on the humps 118D and on the shoulder 119D on the core 101D.

The rear part of the jacket will slip, perfectly matching the shape of these grooves/ridges and will serve as a "turning rifled barrel" for the core upon impact against a hard obstacle.

This grooving/ridging reduces the sliding velocity of the rear portion of the jacket on impact.

Furthermore, under the effect of the grooves/ridges, the sleeve or jacket may be split into strips at the moment of impact.

According to an alternative embodiment which is not shown in detail, the gap remaining between the housing 103 of the core 101 and the striker body 104 may form a cavity to receive the active mass which is, for example, explosive, powder, pyrotechnical composition, liquid such as oil, or other substance, in order to increase the efficiency of the projectile at the moment of impact ; the pressure exerted by the striker body at the moment of impact is then sufficient to activate (ignite) the active mass at the moment of impact. This activation may create a fresh discharge of the striker body which may become a projectile.

As there is likewise a chamber in the housing 109 of the striker body 104 behind the locking member 106, this chamber may likewise accommodate an active mass.

It should likewise be noted that the chambers mentioned hereinabove may also remain empty or may receive additional masses making it possible to position the centre of gravity of the projectile at will or in an optimum manner.

According to an alternative embodiment shown in FIGS. 16 and 17, the bottom of the housing 109 of the striker body is of conical shape and the free end of the finger-shaped member the locking member 106 ends in a conical tip.

I claim:

1. A projectile for a rifled firearm, comprising a hard core (1) surrounded by a continuous jacket (7) of ductile material adapted to cooperate with rifling in the firearm, said core having a nose, a head (2) of ogival shape and an integral substantially cylindrical tail (3), said core being shaped to define a shoulder (6) between said head and said tail, said jacket including a first portion (8) which overlies said nose and head of said core, said jacket including an integral second portion (12) which overlies said tail of said core, said second portion having a greater thickness than said first portion of said jacket, an outer surface of said second portion of said jacket having undulations which form circular grooves (13) at substantially right angles to the longitudinal axis of the projectile, an interior surface of said jacket adjacent said shoulder being shaped to define a free space (14) between said interior surface and said shoulder, anchoring means (9) disposed between an exterior surface of said tail and an interior surface of said second portion of said jacket for locking said jacket and core to one another so that, when said projectile is fired, said core and jacket will be propelled and rotated as a unitary body, said cylindrical tail of said core defining an interior cavity (4), and an inertia block (5) disposed within said cavity, the sizes and shapes of said cavity and inertia block being such that said inertia block substantially fills said cavity.

2. Projectile for a rifled weapon, according to claim 1, characterised in that the means of anchoring the second portion (12) of the jacket (7) on the tail, (3) comprise ridges (9) provided on the exterior surface of the tail (3), the interior surface of the second portion (12) of the jacket being inserted into the said ridges (9).

3. Projectile for a rifled weapon, according to claim 2, characterised in that the ridges extend longitudinally and have a radial edge (**9*a*) and an inclined edge (9*b***), the radial edge being turned towards the same side as the direction of thrust which causes rotation of the projectile.

4. Projectile for rifled weapon, according to claim 1, characterised in that the means of anchoring the second portion (12) of the jacket on the tail (3) comprise longitudinal grooves (10) provided in the tail (3) and into which the interior surface of the second portion (12) of the jacket is inserted.

5. Projectile for rifled weapon, according to claim 1, characterised in that the means of anchoring the second portion (12) of the jacket on the tail (3) comprise grooves (25, 26, 27, 28, 29 and 30) inclined in relation to the longitudinal axis of the projectile and provided in the tail (3) and into which the interior surface of the second portion (12) of the jacket is inserted.

6. A projectile for rifled weapen, according to claim 1 characterised in that the means of anchoring the second portion (12) of the jacket on the tail (3) comprise grooves (29, 30) of which at least one is situated in a plane at right-angles to the longitudinal axis of the tail (3), the others being inclined in relation to the said axis and being provided in the tail (3), the interior surface of the second portion (12) of the jacket being inserted into them.

7. Projectile for rifled ,weapon, according to claim 1, characterised in that a free end of the second portion (12) of the jacket is shrunk onto a free rear end (15) of the tail (3) to provide said anchoring means.

8. Projectile for rifled weapon, according to claim 7, characterised in that the free rear end (15) of the tail (3) comprises ridges (19).

9. Projectile for rifled weapon, according to claim 7, characterised in that the free rear end (15) of the tail (3) comprises grooves (17).

10. Projectile for rifled weapon, according to claim 7, characterised in that the free rear end (15) of the tail (3) comprises ribs (16).

11. Projectile for rifled weapon, according to claim 7, characterised in that the rear free end (15) of the tail (3) comprises flats (18).

12. Projectile for rifled weapon, according to claim 7, characterised in that the free end of the second portion (12) of the jacket shrunk onto the free end of the tail ends in a portion (32) of reduced thickness.

13. Projectile for rifled weapon, according to claims 1 or 7, characterised in that the inertia block (**5*c*) extends beyond the rear end of the rear portion (12**) of the jacket.

14. Projectile for rifled weapon, according to claim 1, characterised in that the inertia block and the cavity (4) comprise conjugate anchoring means (**4*a*, 4*b***).

15. Projectile for rifled weapon, according to claim 1, characterised in that a free space (11) is provided between a free end of the head (2) of the core and the corresponding end of the jacket (7), a lubricating element being inserted between these two elements.

16. Projectile for rifled weapon, according to claim 1, characterised in that the shoulder (6) has the shape of a truncated cone, the small base of which is turned towards the tail.

17. Projectile for rifled weapon, according to claim 1, characterised in that a binder is inserted between the exterior surface of the tail (3) and the interior surface of the second portion (12) of the jacket.

18. Projectile for rifled weapon, according to claim 1, characterised in that the exterior surface of the tail (3) and the corresponding interior surface of the second portion (12) are welded.

* * * * *